US008042566B2

(12) United States Patent
Enicks

(10) Patent No.: US 8,042,566 B2
(45) Date of Patent: Oct. 25, 2011

(54) EX-SITU COMPONENT RECOVERY

(75) Inventor: Darwin Enicks, Colorado Springs, CO (US)

(73) Assignee: Atmel Corporation, San Jose, CA (US)

( * ) Notice: Subject to any disclaimer, the term of this patent is extended or adjusted under 35 U.S.C. 154(b) by 646 days.

(21) Appl. No.: 12/178,097

(22) Filed: Jul. 23, 2008

(65) Prior Publication Data

US 2010/0018554 A1 Jan. 28, 2010

(51) Int. Cl.
*B05B 5/04* (2006.01)
*B05B 5/00* (2006.01)

(52) U.S. Cl. ..... 137/240; 137/266; 137/565.23; 137/565.29; 134/21

(58) Field of Classification Search ..... 137/240, 137/266, 565.23, 565.29, 565.3, 565.33; 134/31, 36; 34/406, 410, 412
See application file for complete search history.

(56) References Cited

U.S. PATENT DOCUMENTS 4,437,479 A * 3/1984 Bardina et al. ..... 134/68
5,045,117 A * 9/1991 Witherell ..... 134/21
5,178,823 A * 1/1993 Hughes ..... 134/21
5,315,766 A * 5/1994 Roberson et al. ..... 134/21
5,711,821 A * 1/1998 Turner et al. ..... 134/21
5,879,467 A * 3/1999 Zhou et al. ..... 134/21
6,004,109 A * 12/1999 Gebele et al. ..... 417/205
6,783,601 B2 * 8/2004 Gray et al. ..... 134/21
6,838,066 B2 1/2005 Rao
7,044,147 B2 5/2006 Enicks et al.
7,080,440 B2 7/2006 Enicks
7,368,000 B2 5/2008 Jain et al.
7,372,058 B2 5/2008 Banine et al.
2003/0159710 A1 * 8/2003 Teranishi et al. ..... 134/21
2005/0268694 A1 * 12/2005 Moriya et al. ..... 134/21
2006/0118178 A1 * 6/2006 Desbiolles et al. ..... 137/565.3

* cited by examiner

*Primary Examiner* — John Rivell
(74) *Attorney, Agent, or Firm* — Fish & Richardson P.C.

(57) ABSTRACT

Disclosed herein are devices, methods and systems for ex-situ component recovery. The ex-situ recovery can be performed by desorbing or outgassing components of a processing system in a recovery system, rather than in the processing system itself. The recovery system can include a docking station and/or a heated vacuum chamber. The heated vacuum chamber can be used to desorb or outgas components that will be located inside the processing system, while the docking station can be used to desorb or outgas components that will be connected to the processing system. The processing system components can be placed under pressure by the recovery system to desorb or outgas contaminants and remove virtual leaks. The recovery system pressure can include a vacuum roughing pump, a turbomolecular pump, and/or a cryogenic pump to apply a pressure necessary to desorb or outgas the components.

13 Claims, 4 Drawing Sheets

EX-SITU COMPONENT RECOVERY

BACKGROUND

This specification relates to ex-situ component recovery.

Semiconductors are manufactured in highly controlled environments. Contaminants that are not controlled or isolated can potentially reduce the yield of a semiconductor manufacturing process. Similarly, contaminants can lead to failures in processing equipment (e.g., reactors) used to manufacture semiconductors. Contaminants (e.g., water, oxygen, atmosphere, etc.) can be introduced to the processing equipment from the atmosphere surrounding the processing equipment. Contaminants can also be introduced to the processing equipment as a byproduct of the processing itself. These contaminants can accumulate on the components of the processing equipment, for example, through absorption, adsorption, or deposition. The accumulation of contaminants on the components of the processing equipment can interfere with normal operation of the processing equipment and, in turn, result in lower quality semiconductors.

Processes can be implemented to reduce the contaminants that are present in or on the components of the processing equipment in which semiconductor devices are manufactured. For example, the components of the processing equipment can be maintained by cleaning, replacing, or otherwise troubleshooting problems (e.g., identifying leaks) of the components of the processing equipment. Before the processing equipment is placed back in service, the components can be recovered (e.g., restored to operational condition) through desorption or outgassing to remove contaminants. The components can be outgassed, for example, in-situ (e.g., in the processing equipment). However, while the contaminants are being desorbed or outgassed from the components in-situ, the processing equipment is unavailable for manufacturing.

SUMMARY

Disclosed herein are devices, methods and systems for ex-situ component recovery. The ex-situ recovery can be performed by desorbing or outgassing components of a processing system in a recovery system, rather than in the processing system itself. The recovery system can include a docking station and/or a heated vacuum chamber. The heated vacuum chamber can be used to desorb or outgas components that will be located inside the processing system, while the docking station can be used to desorb or outgas components that will be connected to the processing system. The processing system components can be placed under reduced pressure by the recovery system to desorb or outgas contaminants and remove virtual leaks. The recovery system can include a vacuum roughing pump, a turbomolecular pump, and/or a cryogenic pump to achieve a pressure necessary to desorb or outgas the components.

Implementations may include one or more of the following features and/or advantages. The processing system can remain available for manufacturing during the desorption or outgassing of contaminants from the processing system components. Troubleshooting is simplified and manufacturing quality is increased because components used to rebuild a processing system are desorbed or outgassed prior to the processing system rebuild. Rate of pressure rise tests for processing systems rebuilt with components recovered in an ex-situ recovery system can be performed in less time than in-situ recovery. Manufacturing throughput is increased by reducing processing system downtime through ex-situ recovery.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Manufacturing throughput can be increased by performing ex-situ recovery of processing system components. The ex-situ recovery can be performed by desorbing, outgassing, or otherwise removing contaminants (e.g., moisture, oxygen, atmosphere, etc.) from components of a processing system in a recovery system. In some implementations, the recovery system can be independent (e.g., separated from) the processing system itself. The recovery system can include a docking station and/or a heated vacuum chamber. The heated vacuum chamber can be used to desorb or outgas components that can be located, for example, inside the processing system (e.g., turntable), while the docking station can be used to desorb or outgas components that can be connected, for example, to the processing system (e.g., valves). The processing system components can be placed under pressure by the recovery system to desorb or outgas contaminants and remove virtual leaks (e.g., physically trapped contaminants). The recovery system can include a vacuum roughing pump, a turbomolecular pump, and/or a cryogenic pump to achieve a pressure to facilitate desorption, outgassing, or other decontamination of the components.

The components can be recovered, for example, until the contaminants detected in the atmosphere of the chamber or docking station are reduced to a defined concentration. The concentration of contaminants can be determined based on a rate of pressure rise test. The rate of pressure rise test is a measure of the increase in closed system pressure over time. The concentration of contaminants can also be determined by detected and identifying each individual contaminant using, for example, a residual gas analyzer.

Components that have been recovered (e.g., decontaminated) can be used to rebuild the processing system. A rate of pressure rise test can be performed to ensure that the processing system is available for processing. If the processing system does not pass the rate of pressure rise test, then troubleshooting can be performed on the processing system. The troubleshooting can be performed without additional desorption or outgassing of the components because the components have already been decontaminated and have individually passed a rate of pressure rise test and/or residual gas analysis. When the system passes the rate of pressure rise test, the system can be placed back in service.

§1.0 Example Ex-Situ Recovery System

Figure 1:
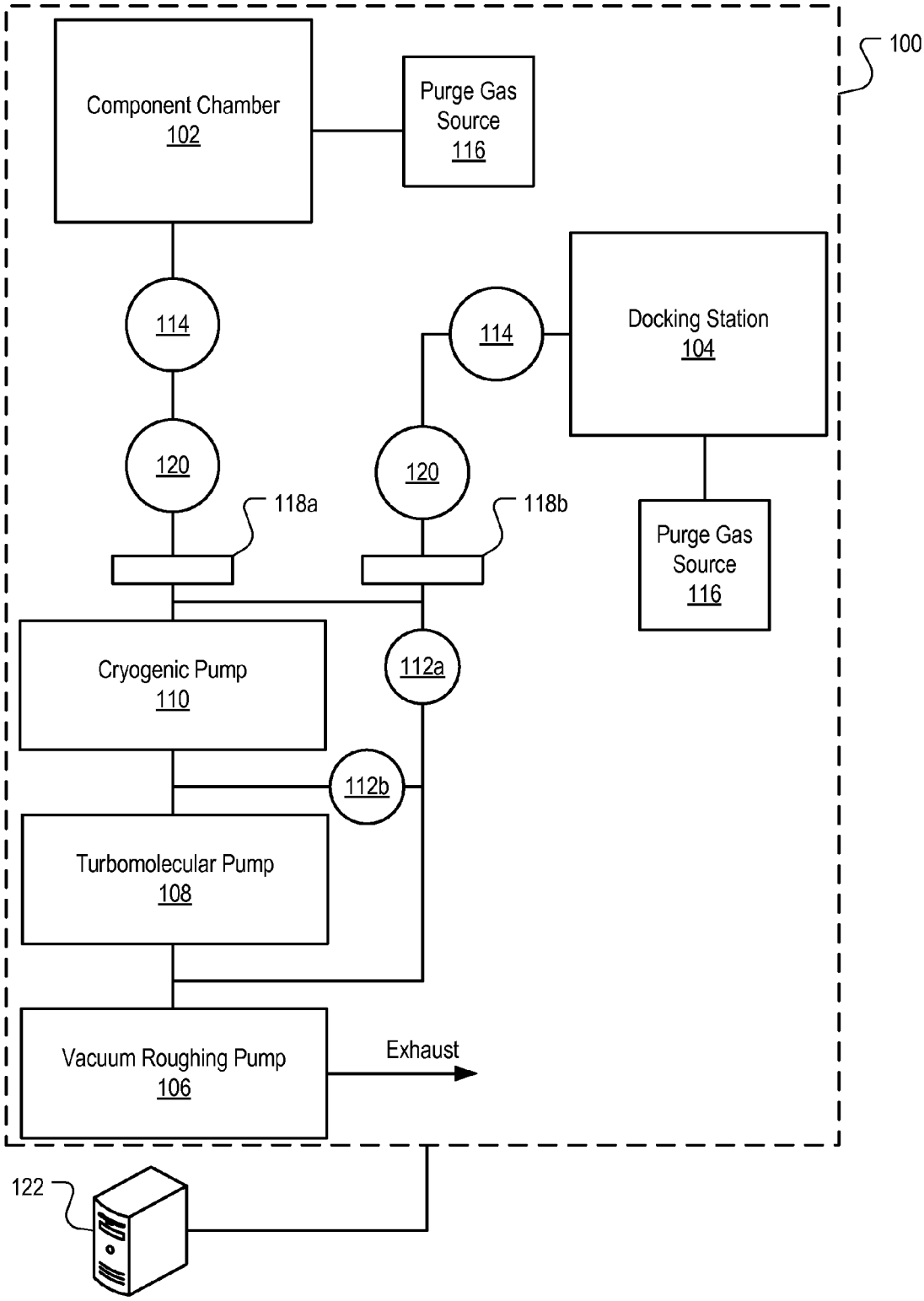
FIG. 1 is a block diagram of an example ex-situ recovery system.

FIG. 1 is a block diagram of an example ex-situ recovery system 100. The recovery system 100 can be implemented to recover components that are used in a processing system.

Component recovery can include, for example, removing contaminants from a component through desorption or outgassing. Throughout this document, outgassing will be used to describe contaminant removal, however, any appropriate process (e.g., desorption) for removing contaminants in a low pressure environment (e.g., vacuum environment) can be used.

The components that are recovered in the recovery system 100 can be any component that is decontaminated prior to use in a system under pressure. The components can be used in processing systems that include, for example, semiconductor reactors (e.g., diffusion reactor, oxidation reactor, rapid thermal annealing reactor, etc.), deposition systems (e.g., polysilicon deposition, nitride deposition, silicon carbon deposition, etc), epitaxy systems (e.g., silicon epitaxy, gallium arsenide epitaxy, silicon germanium epitaxy, etc), or any other semiconductor processing system. Throughout this document, reference will be made to semiconductor processing systems and components. However, the systems, methods, and devices disclosed can be used to recover components from any processing system including those that operate in a low pressure environment.

Ex-situ component recovery is component recovery that can be performed in a system other than (e.g., independent of) the processing system in which the components are used. In some implementations, processing system components can be recovered in a component chamber 102. The component chamber 102 can be a vacuum chamber that is capable of maintaining an internal pressure that is below atmospheric pressure. For example, the component chamber 102 can be implemented to have a defined pressure rating (e.g., 1 nanoTorr). The pressure rating can be defined, for example, based on the components to be recovered, the contaminants to be removed, and the ultimate operational pressure the components will be subjected to.

In some implementations, components that are used inside of a processing system can be recovered in the component chamber 102. Example components that can be received by the component chamber for recovery include valve bodies, chamber liners, electrostatic chucks, gas distribution plates, quartz parts, silicon carbon parts, graphite parts, chemical vapor deposition coated parts, flood guns, ion guns, as well as other processing system components.

In some implementations, components that are connected to the processing system can be attached to the docking station 104 for recovery. For example, valves that only require internal recovery can be connected to the docking station 104. The docking station 104 can also include a portion that can be used to recover components that may include parts or materials that cannot be recovered with other components in the component chamber (e.g., servo motors, lubrication, oil seals, etc). For example, o-rings that are used in a processing system can be manufactured from fluorine. When the o-rings are recovered, it is possible that fluorine molecules will be outgassed into the component chamber 102. In turn, the molecules can contaminate other components that are inside the component chamber 102. Thus, these components should be isolated from other components during recovery. While the recovery system 100 is presented as including both a component chamber 102 and docking station 104, the recovery system 100 can be implemented with either a component chamber 102 or a docking station 104 and operated in a manner similar to that described above.

When the components are received within the component chamber 102 or attached to the docking station 104, the components can be placed under pressure to facilitate outgassing of contaminants. The pressure can be controlled, for example, by a vacuum pump that is connected to the component chamber 102 and the docking station 104. A vacuum pump can control the pressure of the component chamber 102 and docking station 104, for example, by pumping atmosphere from the component chamber 102 and docking station 104. Depending on the application, a single vacuum pump may achieve the defined pressure. For example, a vacuum roughing pump 106 can be used for applications that require a pressure greater than approximately one militorr. When lower pressures are required, additional pumps can be used in conjunction with the vacuum roughing pump 106.

In some implementations, a turbomolecular pump 108 can be connected to the component chamber 102 and docking station 104. For example, an inlet of the turbomolecular pump 108 can be connected to pump ports of the component chamber 102 and the docking station 104. The roughing pump can have an inlet that is connected to an outlet of the turbomolecular pump 108 and the pump ports of the component chamber 102 and docking station 104. In these implementations, the roughing vacuum pump 106 can be used to obtain a first pressure in the component chamber 102 and docking station 104. When the first pressure is obtained, the turbomolecular pump 108 can be used to obtain a second pressure that is lower than the first pressure. For example, a turbomolecular pump 108 can be used to obtain a pressure of approximately 1 microtorr.

When still lower pressures are required, a cryogenic pump 110 can also be connected to the component chamber 102 and docking station 104 at the pump ports. The cryogenic pump 110 can be used, for example, to obtain pressures far less than 1 microtorr (e.g., less than 1 nanotorr). The cryogenic pump 110 can have an inlet that is connected to the pump ports of the component chamber 102 and the docking station 104. In turn, the inlet of the turbomolecular pump 108 can be connected to an outlet of the cryogenic pump 110. The vacuum roughing pump 106 can, in turn, be connected to the turbomolecular pump 108 in a manner similar to that described above.

In some implementations, the pumps can be selectively operated to successively reduce the pressure of the component chamber 102 and the docking station 104. In addition to selectively operating the pumps, bypass valves 112*a*, 112*b* can be used to selectively couple the pumps to the component chamber 102 and docking station 104. For example, when the vacuum roughing pump 106 is selected to reduce the pressure of the component chamber 102 and docking station 104, then bypass valve 112*a* can be opened while bypass valve 112*b* is closed. Manipulating the bypass valves 112*a*, 112*b* in this manner creates a direct path from the component chamber 102 and docking station 104 to the vacuum roughing pump 106, bypassing the cryogenic pump 110 and the turbomolecular pump 108.

Similarly, when the vacuum roughing pump 106 and turbomolecular pump 108 are both selected to reduce the pressure of the component chamber 102 and the docking station 104, both bypass valves 112*a*, 112*b* can be opened. When both bypass valves 112*a*, 112*b* are open, a path from the component chamber 102 and the docking station 104 to the turbomolecular pump 108 is created that bypasses the cryogenic pump 110. This configuration can also be used when all three pumps are used to reduce the pressure in the component chamber 102 and docking station 104. For example, once the cryogenic pump 110 is selected for operation, then atmosphere will flow through the cryogenic pump 110 to further reduce the pressure of the component chamber 102 and docking station 104.

The pressure of the component chamber 102 and docking station 104 can be further controlled using a throttle valve 114. In some implementations, a separate throttle valve 114 can be connected to each of the component chamber 102 and the docking station 104. Using separate throttle valves 114 facilitates independent control of the pressure in the component chamber 102 and docking station 104. Therefore, components requiring different outgassing pressures can be recovered in the component chamber 102 and docking station 104, respectively.

When components are placed under pressure, the contaminants are outgassed from the components. To facilitate removal of the contaminants from the component chamber 102 and docking station 104, a purge gas can be cycled through the component chamber 102 and docking station 104. In some implementations, the purge gas can originate from a purge gas source 116 that can be connected to the component chamber 102 and docking station 104. The purge gas can be, for example, nitrogen, argon, dry-oxygen, or any inert and/or non-reactive gas. The purge gas can flow from the purge gas source 116 to the component chamber 102 and docking station 104. When contaminants are outgassed from the components they become entrained in the purge gas stream and are carried out through the exhaust; as the purge gas is cycled through the component chamber 102 and docking station 104, the contaminants can be removed from the component chamber 102 and docking station 104 as exhaust.

Reactive gases may also be used to chemically attach to contaminants and remove them from various surfaces. Non-reactive purge gas can be introduced simultaneously with the reactive gases to clean surfaces of contaminants, reduce virtual leaks, desorb gases from materials, and carry the contaminants from the system.

Reactive gases and purge gases may also be introduced in an alternating order. For example, reactive gases may be introduced to chemically enhance surface cleaning. In turn, purge gases can be introduced to remove byproducts of the chemical enhancement from the system.

Back-streaming traps 118*a*, 118*b* can be used in the recovery system 100 to prevent expelled gas from re-entering the component chamber 102 or docking station 104. The back-streaming traps 118*a*, 118*b* can be implemented, for example, to allow the purge gas and contaminant to flow toward the pumps but inhibit flow back toward the component chamber 102 and docking station 104. Therefore, contaminants cannot be introduced to the components through back-streaming of gas carrying contaminants.

An isolation valve 120 can be connected to the recovery system 100 to facilitate isolation of the component chamber 102 or docking station 104 from the rest of the recovery system 100. For example, an isolation valve 120 can be connected between the component chamber 102 and the back-streaming trap 118*a* to isolate the component chamber 102 from the rest of the system. Similarly, an isolation valve 120 can be connected between the docking station 104 and the back-streaming trap 118*b*. The isolation valves 120 can be used, for example, when the door of the component chamber 102 is opened to prevent a rush of atmosphere into the recovery system 100, because a rush of atmosphere into the recovery system 100 can damage the pumps.

In some implementations, the recovery system 100 can be controlled manually. In other implementations, the recovery system 100 can be controlled by a computing system 122. The computing system 122 can be a computer, server, or any other computing device capable of performing process control. The computing system can receive information from the component chamber 102 and the docking station 104. The information can include, for example, pressure information, temperature information, and other information related to the control of the system. The computing system 122 can also be in communication with the purge gas source 116 to control the flow of purge gas into the system. The computing system can be further in communication with the bypass valves 112*a*, 112*b*, throttle valves 114, and isolation valves 120 to control the positioning of the valves. The pumps can also be controlled by the computing system 122.

§2.0 Example Component Chamber

Figure 2:
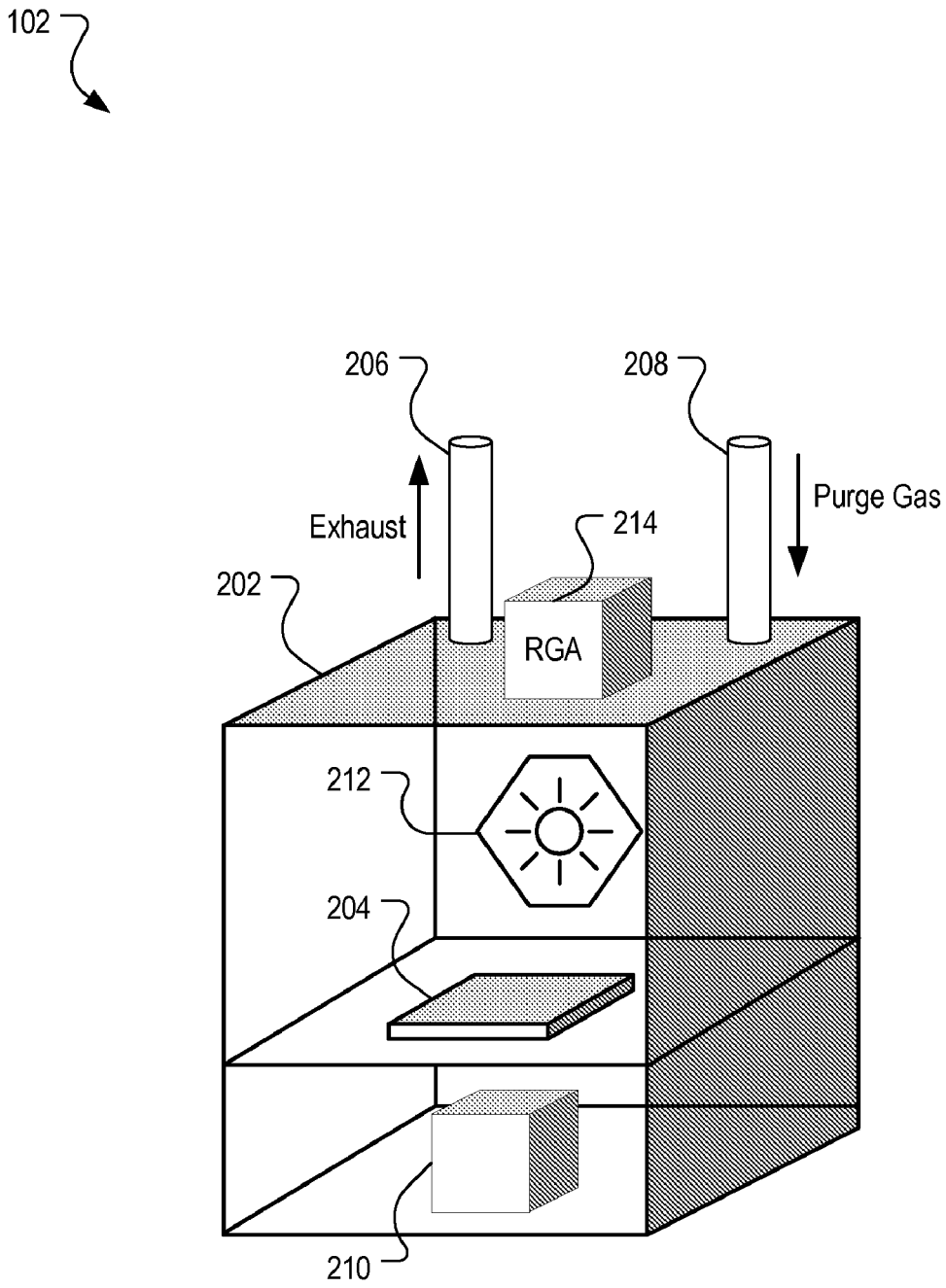
FIG. 2 is a block diagram of an example component chamber.

FIG. 2 is a block diagram of an example component chamber 102. The component chamber 102 can include a housing 202. The housing 202 can define an inner volume of the component chamber 102. In some implementations, the housing 202 can define an inner volume that is large enough to receive components 204. The components 204 can be, for example, processing system components. The components 204 can be received in the inner volume of the component chamber 102 to be recovered.

The component chamber 102 can include a pump port 206. The pump port 206 can be, for example, a port that connects the component chamber 102 to a vacuum pump. In turn, the vacuum pump can use the pump port 206 to extract atmosphere from the component chamber 102. When atmosphere is extracted from the component chamber 102, a low pressure environment is created in the inner volume of the housing 202 to facilitate recovery of the components 204. The low pressure environment can facilitate recovery of the components 204 by causing outgassing of contaminants from the components 204. Once the contaminants are outgassed, they can be absorbed into the atmosphere of the component chamber 102. The pump port 206 can also connect the component chamber to a docking station and/or a bypass valve.

In some implementations, the component chamber 102 can also include a purge gas inlet 208. The purge gas inlet 208 can be, for example, a port that connects the component chamber 102 to a purge gas source. The purge gas source can provide a purge gas to the inner volume defined by the housing 202. The purge gas can facilitate recovery of components 204 in the component chamber 102 by attaching to contaminants that are outgassed from the components 204. In turn, as the pump continues to pump atmosphere from the component chamber, the contaminants that are attached to the purge gas molecules can also be pumped from the component chamber 102 as exhaust.

As purge gas continues to cycle through the component chamber 102 the concentration of contaminants can decrease. The concentration of contaminants that are outgassing from the component 204 can be determined, for example, based on a rate of pressure rise test. A rate of pressure rise test can determine the outgassing rate of contaminants based on the rise in pressure of a closed system over a period of time. When the rate of pressure rise is less than a threshold, then the component has been sufficiently recovered (e.g., decontaminated). To perform the rate of pressure rise test, the pressure of the component chamber can be measured over a period of time.

In some implementations, a pressure sensor 210 can be included in the component chamber 102. The pressure sensor 210 can be implemented, for example, to measure the instantaneous pressure of the component chamber 102. To determine the rate of pressure rise of the system, the instantaneous pressure measured by the pressure sensor 210 can be read at a start time and a stop time. In turn, the rate of pressure rise can be determined based on the pressure difference between the start time and the stop time. If the rate of pressure rise satisfies the threshold (e.g., 1 militorr/min) then the component 204 can used to rebuild the processing system. However, if the rate of pressure rise does not satisfy the threshold, then recovery of the component 204 can continue. The threshold rate of pressure rise can be set, for example, based on the application for which the processing system component being recovered is used. The pressure sensor 210 can be, for example, a baratron or any other suitable pressure measurement device.

The pressure sensor 210 can also be used to regulate the pressure of the component chamber 102 during recovery. When a target pressure is required to outgas components, then the pressure sensor 210 can be used to determine if the target pressure has been achieved. In a manually operated system, the pressure sensor 210 can be read and the appropriate valves adjusted to achieve the target pressure. In computer controlled systems, the pressure sensor 210 can provide pressure information to a computing system, which, in turn, can adjust the appropriate valve positions and selectively control the appropriate pumps to achieve the target pressure.

In some implementations, a heating element 212 can be included in the component chamber 102. The heating element 212 can be used, for example, to increase the outgassing rate of contaminants from the components 204. As the temperature of the component chamber 102 increases, the contaminant molecules and the purge gas molecules can be excited. This excitation of the molecules can increase the rate of outgassing of the contaminants as well as the rate of absorption of the contaminants by the purge gas. Accordingly, the concentration of contaminants can be decreased more quickly than if the recovery were performed at a cooler temperature. Thus, recovery of the component can be achieved more quickly. The heating element 212 can be, for example, a resistive heating element, conductive heating element, infrared lamp, ultraviolet lamp, or any other suitable heating element.

The component chamber 102 can optionally include a residual gas analyzer 214. The residual gas analyzer 214 can be used, for example, to detect and identify contaminants that are being outgassed from the components 204. The residual gas analyzer 214 can identify the contaminants, for example, using a quadrapole mass spectrometer to determine the atomic mass of the contaminants being outgassed based on the electronic charge of the molecules.

§3.0 Example Docking Station

Figure 3:
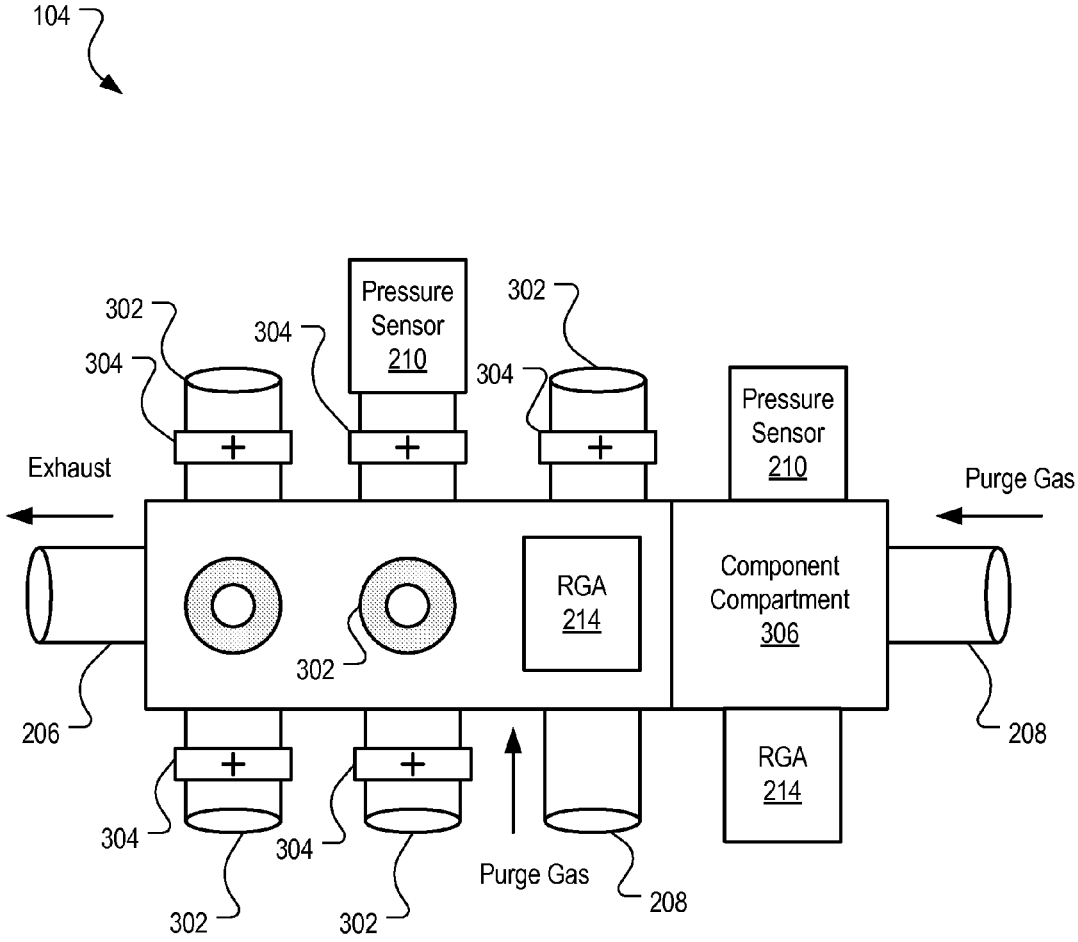
FIG. 3 is a block diagram of an example docking station.

FIG. 3 is a block diagram of an example docking station 104. The docking station 104 can interface with components of a processing system through docking ports 302. The docking ports 302 can each be structurally uniform, or the docking ports 302 can vary in size and configuration according to the components with which the docking ports 302 interface. For example, if a component has a threaded male interface, then a docking port 302 can have a corresponding threaded female interface to receive the component.

The docking ports 302 can include isolation valves 304. The isolation valves 304 can be closed to isolate the corresponding docking port 302. The docking port 302 may be isolated, for example, when a component is not attached to the docking port 302. Similarly, the docking port 302 may be isolated when components are being connected to, and disconnected from, the docking port 302. Isolating the docking port 302 can reduce the likelihood of damage to the pumps that can be caused by a rush of atmosphere from a docking port 302 that is not isolated. The isolation valves 304 can be manually operated or automated.

The docking station 104 can also include a component compartment 306. The component compartment 306 can be a portion of the docking station 104 that can be used to recover components that should not be recovered in the same atmosphere with other components. For example, components that include oil seals should not be recovered in the component chamber with other components because the oil seals can contribute contamination to the atmosphere of the component chamber. Therefore, the component compartment 306 can be isolated from the docking ports 302 so that the components recovered in the component compartment do not contaminate the components attached to the docking ports 302.

The docking station 104 can include a pump port 206. As discussed above, the pump port 206 can be, for example, a port that connects the docking station 104 to a vacuum pump. In turn, the vacuum pump can use the pump port 206 to extract atmosphere from the docking station 104. When atmosphere is extracted from the docking station 104, a low pressure environment is created in the component compartment 306 and the docking ports 302. The low pressure environment can cause outgassing of contaminants from components in the component compartment 306 or connected to the docking ports 302. The pump port 206 can also connect the docking station to a component chamber and a bypass valve.

In some implementations, the docking station 104 can also include purge gas inlets 208. The purge gas inlets 208 can be, for example, ports that connect the docking station 104 to a purge gas source. A separate purge gas inlet 208 can be provided for the docking ports 302 and the component compartment 306, respectively. Maintaining separate purge gas inlets reduces cross-contamination between the components connected to the docking ports 302 and the component compartment 306.

As purge gas cycles through the components connected to the docking ports 302 and located in the component compartment 306, the concentration of contaminants can decrease. The concentration of contaminants that are outgassing from the components can be determined, for example, based on a rate of pressure rise test. In some implementations, a pressure sensor 210 can be connected to the docking station 104 to determine the rate of pressure rise. In some implementations, a separate pressure sensor 210 can be provided for the docking ports 302 and component compartment 306, respectively. The pressure sensor 210 for the docking ports 302 can be connected to one of the docking ports 302. The pressure sensor 210 for the component compartment 306 can be connected to the component compartment 306.

The pressure sensor 210 can be implemented to measure the instantaneous pressure of the component chamber 102. To determine the rate of pressure rise of the system, the instantaneous pressure measured by the pressure sensor 210 can be read at a start time and a stop time. In turn, the rate of pressure rise can be determined based on the pressure difference between the start time and the stop time. If the rate of pressure rise satisfies the threshold (e.g., 1 militorr/min) then the component can be used to rebuild the processing system. However, if the rate of pressure rise does not satisfy the threshold, then recovery of the component 204 can continue. The threshold rate of pressure rise can be set, for example, based on the application for which the processing system component being recovered is used. The pressure sensor 210 can be, for example, a baratron or any other suitable pressure measurement device.

The pressure sensor 210 can also be used to regulate the pressure experienced at the docking ports 302 and in the component compartment 306 during recovery. For example, when a target pressure is required to outgas components, then the pressure sensor 210 can be used to determine if the target pressure has been achieved. In a manually operated system, the pressure sensor 210 can be read and the appropriate valves adjusted to achieve the target pressure. In computer controlled systems, the pressure sensor 210 can provide pressure information to a computing system, which, in turn, can adjust the appropriate valve positions and selectively control the appropriate pumps to achieve the target pressure.

The docking station 104 can optionally include a residual gas analyzer 214. The residual gas analyzer 214 can be used, for example, to detect and identify the contaminants that are being outgassed from the components. The residual gas analyzer 214 can identify the contaminants, for example, using a quadrapole mass spectrometer to determine the atomic mass of the contaminants being outgassed based on the electronic charge of the molecules. In some implementations, a separate residual gas analyzer 214 can be provided for the docking ports 302 and the component compartment 306.

§4.0 Example Process Flow

Figure 4:
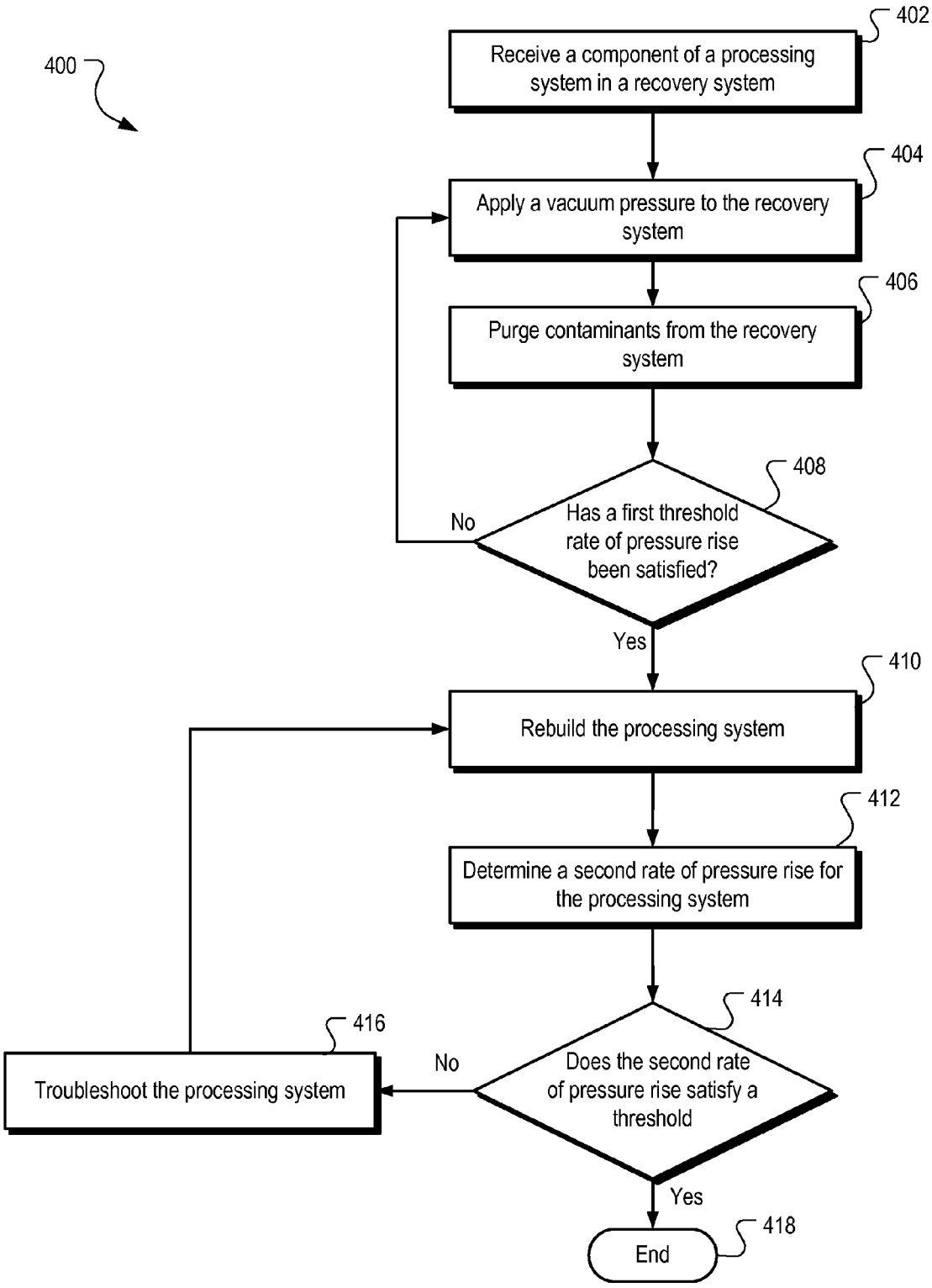
FIG. 4 is a flow chart of an example process of ex-situ component recovery.

FIG. 4 is a flow chart of an example process 400 of ex-situ component recovery. The process 400 can be performed, for example, by the recovery system 100 of FIG. 1.

Stage 402 receives a component of a processing system in a recovery system. In some implementations, the recovery system is independent of the processing system. The component of the processing system can be received, for example, by the component chamber 102 or the docking station 104.

Stage 404 applies a vacuum pressure to the recovery system. In some implementations, a first pump and a second pump can be selectively engaged to apply the vacuum pressure to the recovery system. The vacuum pressure can be applied until a first threshold rate of pressure rise is satisfied. The first threshold rate of pressure rise can have a magnitude that corresponds to a defined contaminant level. The vacuum pressure can be applied, for example, by the vacuum roughing pump 106, the turbomolecular pump 108, and/or the cryogenic pump 110.

Stage 406 purges contaminants from the recovery system. In some implementations, the contaminants can be purged by cycling a purge gas through the recovery system until the first threshold rate of pressure rise is satisfied. Cycling the purge gas through the recovery system can remove contaminants from the recovery system. The contaminants can be purged, for example, by the purge gas source 116 and the vacuum roughing pump 106, turbomolecular pump 108, and the cryogenic pump 110.

Stage 408 determines whether the first rate of pressure rise satisfies a threshold. In some implementations, the first threshold rate of pressure rise can correspond to a defined contaminate concentration. If the first rate of pressure rise does not satisfy the threshold, then the process can continue to stage 404 to continue to recover the component. If the first rate of pressure rise satisfies the threshold, the process can continue to stage 410. The first rate of pressure rise can be determined, for example, by the pressure sensor 210.

Stage 410 rebuilds the processing system. The rebuilding can be performed manually or in an automated assembly system. In some implementations, the processing system can be rebuilt with the components that were recovered in stages 402 to 408.

Stage 412 determines a second rate of pressure rise for the processing system. In some implementations, the second rate of pressure rise for the processing system can identify if the system is available to be placed in service. The second rate of pressure rise test can be performed, for example, by a pressure sensor and a computing system.

Stage 414 determines whether the second rate of pressure rise satisfies a threshold. The determination can be made, for example, by measuring a first pressure at a start time and measuring a second pressure at a second time. If the second rate of rise does not satisfy the threshold, the process 400 can continue to stage 416. If the second rate of rise satisfies the threshold, the process 400 can end at stage 418.

Stage 416 troubleshoots the processing system. In some implementations, the troubleshooting can be performed on components or connections of the system that were not recovered in the recovery system 100. The troubleshooting can be performed manually or by an automated troubleshooting system.

What is claimed is:

1. An ex-situ recovery system, comprising:

a component chamber to receive a component of a processing system, the component chamber having a first purge gas inlet to receive a purge gas source;

a docking station to receive a connection to the component of the processing system, the docking station having a second purge gas inlet to receive the purge gas source; and a turbomolecular pump coupled to the component chamber and the docking station to apply a first vacuum pressure to the component chamber and the docking station.

2. The ex-situ recovery system of claim 1, further comprising a cryogenic pump coupled to the component chamber and the docking station to apply a second vacuum pressure.

3. The ex-situ recovery system of claim 2, further comprising a pump selector connected to the cryogenic pump and the turbomolecular pump to selectively couple the cryogenic pump and the turbomolecular pump to the component chamber and the docking station.

4. The ex-situ recovery system of claim 3, further comprising a processing device coupled to the pump selector to control the selective coupling of the cryogenic pump and the turbomolecular pump.

5. The ex-situ recovery system of claim 3, wherein the pump selector comprises a bypass valve.

6. The ex-situ recovery system of claim 1, further comprising:

a first throttle valve coupled to the turbomolecular pump and the component chamber to control the vacuum pressure applied to the component chamber; and a second throttle valve coupled to the turbomolecular pump and the docking station to control the vacuum pressure applied to the docking station.

7. The ex-situ recovery system of claim 1, wherein the ex-situ recovery system is independent of the processing system.

8. The ex-situ recovery system of claim 1, wherein the component chamber comprises a heated vacuum chamber.

9. The ex-situ recovery system of claim 1, further comprising a pressure sensor coupled to the component chamber to determine a pressure in the component chamber.

10. The ex-situ recovery system of claim 1, further comprising a pressure sensor coupled to the docking station to determine a pressure in the docking station.

11. The ex-situ recovery system of claim 1, wherein the purge gas is argon or nitrogen.

12. An ex-situ recovery system, comprising:

a component chamber having a first pump port;

a docking station having a second pump port that is coupled to the first pump port;

a cryogenic pump having an inlet that is coupled to the first pump port and the second pump port and having an outlet;

a turbomolecular pump coupled to the outlet; and a pump selector having a first end coupled to the first pump port, the second pump port, and the inlet and having a second end coupled to the outlet.

13. A device, comprising:

means for receiving a component of a processing system, the means for receiving being independent of the processing system;

means for selectively engaging a first pump and a second pump to apply a vacuum pressure to the recovery system; and means for purging contaminants from the means for receiving with a purge gas until a threshold rate of pressure rise is satisfied in the means for receiving.

* * * * *

UNITED STATES PATENT AND TRADEMARK OFFICE

CERTIFICATE OF CORRECTION

PATENT NO. : 8,042,566 B2
APPLICATION NO. : 12/178097
DATED : October 25, 2011
INVENTOR(S) : Darwin Gene Enicks It is certified that error appears in the above-identified patent and that said Letters Patent is hereby corrected as shown below:

In Column 4, Line 9, delete “militorr.” and insert -- millitorr. --, therefor.

In Column 6, Line 65, delete “militorr” and insert -- millitorr --, therefor.

In Column 8, Line 44 (Approx.) delete “militorr” and insert -- millitorr --, therefor.

Signed and Sealed this
Twenty-seventh Day of December, 2011

David J. Kappos

David J. Kappos
*Director of the United States Patent and Trademark Office*